US007620337B2

(12) United States Patent
Nakamoto et al.

(10) Patent No.: US 7,620,337 B2
(45) Date of Patent: Nov. 17, 2009

(54) IMAGE HEATING APPARATUS AND IMAGE FORMING APPARATUS WITH CONTROLLED SWITCH OUT OF STAND-BY STATE

(75) Inventors: Ikuo Nakamoto, Toride (JP); Yasuhiro Hayashi, Moriya (JP); Shigeaki Takada, Kashiwa (JP); Kazuhiro Hasegawa, Toride (JP); Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/693,045

(22) Filed: Mar. 29, 2007

(65) Prior Publication Data

US 2007/0230983 A1 Oct. 4, 2007

(30) Foreign Application Priority Data

Mar. 31, 2006 (JP) ..... 2006-098916

(51) Int. Cl.
*G03G 15/20* (2006.01)

(52) U.S. Cl. ..... 399/69; 399/70; 399/328

(58) Field of Classification Search ..... 399/69, 399/70, 328

See application file for complete search history.

(56) References Cited

U.S. PATENT DOCUMENTS 6,097,926 A * 8/2000 Takagi et al. ..... 399/328
2005/0254845 A1* 11/2005 Taki et al. ..... 399/45
2005/0271408 A1* 12/2005 Hayashi ..... 399/70

FOREIGN PATENT DOCUMENTS

| | | |
|---|---|---|
| JP | 2002-311745 | 10/2002 |
| JP | 2003-316181 | 11/2003 |
| JP | 2005-345969 | 12/2005 |
| JP | 2006-011294 | 1/2006 |

* cited by examiner

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

An image heating apparatus includes a rotatable image heating member for heating an image on a recording material; a pressing member for forming a nip, with the image heating member, in which the recording material is nipped and conveyed; heating means for heating a part of the image heating member; drive means for rotationally driving the image heating member; contacting-and-separating means for contacting and separating said image heating member and said pressing member relative to each other; standby control means for heating said image heating member in a predetermined period, while said image heating member is rotated, in a state of separation between said image heating member and said pressing member during standby; and pressing operation control means for contacting said image heating member and said pressing member, wherein when an image forming signal is inputted in the predetermined period during the standby, said image heating member and said pressing member are contacted after heating of said image heating member is stopped and then rotation of said image heating member is stopped.

12 Claims, 10 Drawing Sheets

IMAGE HEATING APPARATUS AND IMAGE FORMING APPARATUS WITH CONTROLLED SWITCH OUT OF STAND-BY STATE

FIELD OF THE INVENTION AND RELATED ART

The present invention relates to an image heating apparatus suitable for being mounted as a fixing apparatus in an image forming apparatus such as a copying machine, a printer, or a facsimile apparatus.

In an image forming apparatus such as an electrophotographic apparatus or an electrostatic recording apparatus, an unfixed toner image is formed on a recording material such as paper and fixed on the recording material as a permanent fixed image by heating and pressing the unfixed toner image using a fixing apparatus. As the fixing apparatus, a fixing apparatus using a roller fixing method in which a fixing nip is formed between a pressing roller and a fixing roller internally holding a heater such as a halogen lamp by pressing the pressing roller against the fixing roller to perform fixation in the fixing nip has been employed.

However, in the case where a heat-generating member such as the halogen lamp as a heat source, the fixing roller is heated by radiant heat of the heat-generating member, so that it takes some time to increase a temperature of the fixing roller up to a predetermined setting temperature, i.e., the fixing apparatus requires some warm(ing)-up time.

Japanese Laid-Open Patent Application No. 2002-311745 has disclosed a fixing apparatus reduced in warm-up time. In the fixing apparatus, an electroconductive layer is provided to a roller or a belt and induction heating is locally effected by an exciting coil. Further, during the heating of the image heating member in the warm-up time, a rotation speed of the fixing member is made slower than that during an ordinary fixing operation and the pressing member is moved apart from the image heating member.

By making a rotation speed of the image heating member slower than that during an image heating operation and moving the pressing member apart from the image heating member, it is possible to ensure the reduction in warm-up time through a decrease in amount of heat dissipated from the image heating member into ambient air and prevention of heat transfer from the image heating member to the pressing member.

Further, it is possible to prevent the image heating member from excessively provide heat to the pressing member, so that image failure such as uneven glossiness or the like can be prevented. More specifically, when the image heating member and the pressing member contact each other to increase a temperature of the pressing member up to about a controlled temperature of the image heating member, excessive heat is provided to a recording material. As a result, moisture contained in a temperature or the recording material is generated as water vapor in a fixation nip, so that the uneven glossiness, between a water vapor portion and a non-water vapor portion can occur. During the warm-up, by moving the pressing member from the fixing member (image heating member) to prevent the pressing member from being excessively provided with heat, it is possible to prevent image failure such as the above described uneven glossiness or the like.

In the image heating apparatus such that a part of the image heating member is heated, it is necessary to provide a period in which the image heating member is rotated and heated even during a standby period in which the apparatus awaits input of an image forming signal. In other words, by providing the period in which the image heating member is rotated and heated, an irregularity in temperature on the image heating member is prevented.

However, in the case where pressure application is effected in a rotation state of the image heating member when the image forming signal is inputted during the standby state, a surface of the fixing member or the pressing member is liable to be damaged due to friction between the fixing member and the pressing member. For this reason, it is desirable that the fixing member is caused to contact the pressing member in a state in which rotation of the fixing member is stopped.

Further, when the fixing member and the pressing member contact each other while a part of the stopped fixing member is locally heated, an irregularity in temperature in a circumferential direction of the fixing member occurs, so that there arises uneven glossiness in an outputted image.

SUMMARY OF THE INVENTION

A principal object of the present invention is to prevent an irregularity in temperature of a fixing member caused during a transition from a separation state to a pressing state between the fixing member and a pressing member on the basis of an image input signal.

According to an aspect of the present invention, there is provided an image heating apparatus comprising:

a rotatable image heating member for heating an image on a recording material;

a pressing member for forming a nip, with the image heating member, in which the recording material is nipped and conveyed;

heating means for heating a part of the image heating member;

drive means for rotationally driving the image heating member;

contacting-and-separating means for contacting and separating said image heating member and the pressing member relative to each other;

standby control means for heating the image heating member in a predetermined period, while the image heating member is rotated, in a state of separation between the image heating member and the pressing member during standby; and pressing operation control means for contacting the image heating member and the pressing member, wherein when an image forming signal is inputted in the predetermined period during the standby, the image heating member and the pressing member are contacted after heating of the image heating member is stopped and then rotation of the image heating member is stopped.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described more specifically based on embodiments with reference to the drawings. However, the present invention is not limited to these embodiments.

Embodiment 1

<Image Forming Portion>

Figure 1:
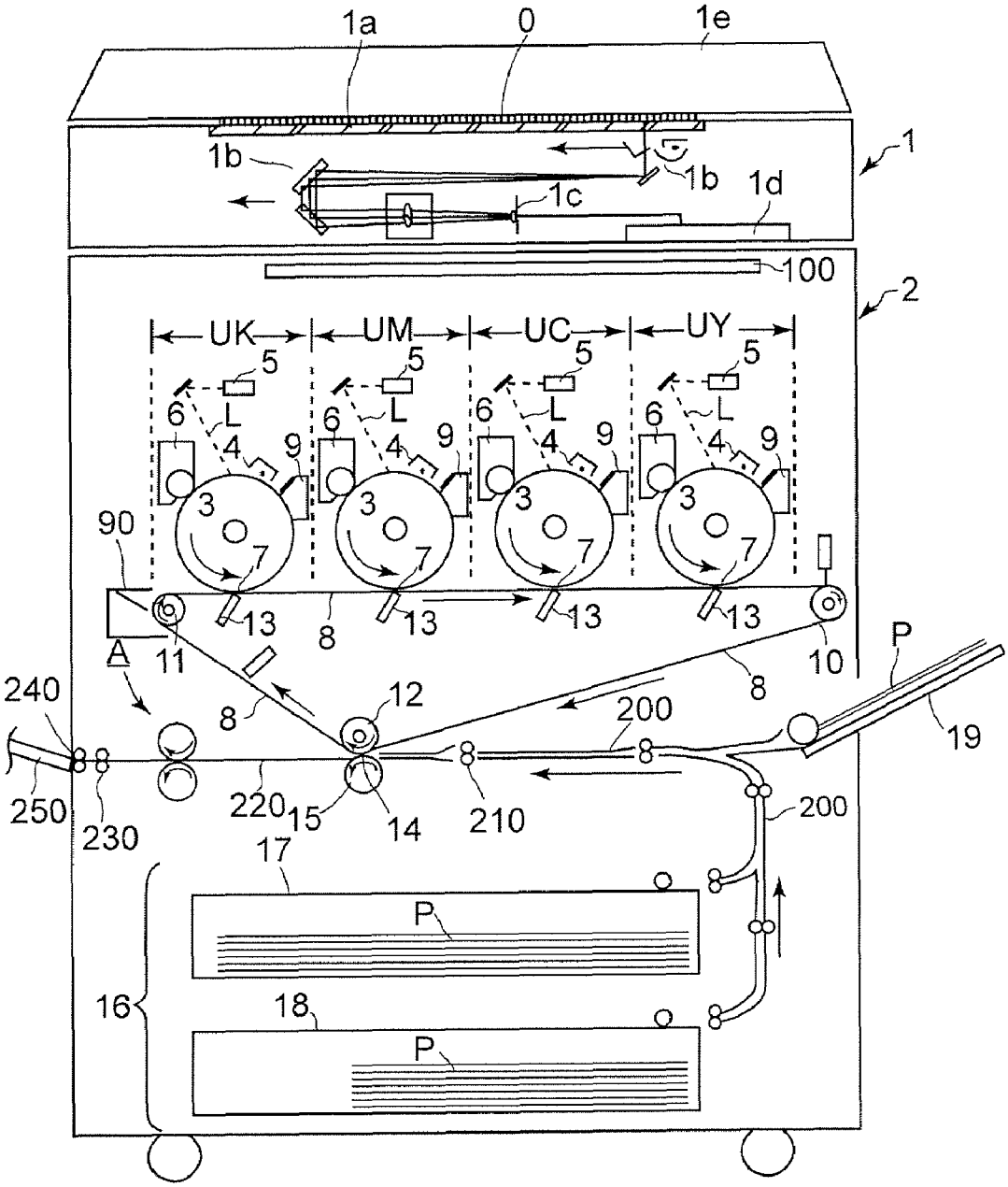
FIG. 1 is a schematic constitution view of an image forming apparatus in Embodiment 1.

FIG. 1 is a longitudinal sectional view showing a schematic constitution of an image forming apparatus of this embodiment. This image forming apparatus is an electrophotographic full-color multifunction machine functioning as a printer, a copying machine, and a facsimile apparatus. First, a general structure of the image forming portion will be described.

An image reading portion 1 effects scanning light exposure of an image of a color image original O, placed on an original supporting platen glass 1*a*, with a moving optical system 1*b* and effects photoelectric reading of the image as a color separation image signal by a full-color sensor (CCD charge coupled device) 1*c*. The color separation image signal is subjected to predetermined image processing by an image processing portion 1*d* and sent to a control unit (control means) 100 of an image output portion 2. On the original supporting platen glass 1*a*, an original pressing plate or original automatic feeding device (ADF (automatic document feeder) or RDF (recirculating document feeder)) 1*e* is disposed.

The control unit 100 includes a central processing unit (CPU) having functions of drive of respective loads in the image forming apparatus, information gathering and analysis with sensors, data exchange with an operating portion (user interface), and the like. All the portions or constitutes of the image forming apparatus are centralizedly controlled by the control unit 100.

The image output unit 2 includes four (first to fourth) image forming units for black (UK), magenta (UM), cyan (UC) and yellow (UY) which are disposed therein in tandem arrangement from left to right on the drawing in this order. Each of the image forming units is a laser exposure type electrophotographic processing mechanism and has the same constitution. The image forming units UK, UM, UC and UY are used for forming toner images of black, magenta, cyan and yellow, respectively.

More specifically, in each of the image forming units UK, UM, UC and UY, a drum-type electrophotographic photosensitive member 3 as an image bearing member (hereinafter simply referred to as a "drum") is rotationally driven in a counterclockwise direction of an indicated arrow. An outer peripheral surface of the drum 3 is electrically charged uniformly by a primary charger 4. The uniformly charged surface of the drum 3 is subjected to scanning exposure to laser light L with a laser exposure device 5 to form an electrostatic latent image on the basis of the color separation image signal. The electrostatic latent image is visualized as a toner image at the drum surface by a developing apparatus 6. The developing apparatuses 6 of the first to fourth image forming units UK, UM, UC and UY accommodate a black toner, a magenta toner, a cyan toner, and a yellow toner, respectively.

On the basis of the color separation image signal sent from the image processing portion 1*d* to the control unit 100, the first image forming unit UK is controlled so as to form a black toner image on the surface of the drum 3 at a predetermined control timing. Similarly, the second to fourth image forming units UM, UC and UY are controlled so as to form a magenta toner image, a cyan toner image, and a yellow toner image, respectively, on the surface of an associated drum 3 at a predetermined control timing.

The thus formed toner images on the surfaces of the drums of the respective image forming units are successively transferred, in a superposition manner at an associated primary transfer portion 7, onto a surface of an intermediary transfer belt 8 which is an endless and flexible intermediary transfer member to be rotationally driven (hereinafter simply referred to as a "belt"). As a result, on the surface of the belt 8, an unfixed full-color toner image is formed by the superposition of the four toner images. In each of the image forming units, the toner remaining on the drum 3 without being transferred onto the belt 8 is removed by a cleaning apparatus 9.

The belt 8 is extended around a drive roller 10, a follower roller 11 also functioning as a tension roller, and a secondary transfer opposing roller 12 and is rotationally driven in a clockwise direction of an indicated arrow at a rotation speed substantially equal to that of the drum 3. The respective primary transfer portions 7 are formed by causing the belt portion between the drive roller 10 and the follower roller 11 to face or contact the lower surfaces of the drums 3 of the respective image forming units. At each of the primary transfer portions 7, a primary transfer charger 13 is disposed at a back surface of the belt 8 and supplied with a predetermined voltage during primary transfer of the toner image.

The unfixed full-color toner image (constituting of the four toner images) formed on the belt 8 reaches a secondary transfer portion 14 by a further rotation of the belt 8. The secondary transfer portion 14 is formed by nipping and contacting the belt 8 between the secondary transfer opposing roller and a secondary transfer roller 15. A nip between the belt 8 and the secondary transfer roller 15 is the secondary transfer portion 14. To the secondary transfer portion 14, a sheet-like recording material P is fed from a sheet (paper) supply unit 16 or a manual feed tray 19 at a predetermined control timing, and the unfixed full-color toner image on the surface of the drum 3 is secondary-transferred onto the surface of the recording material P at the secondary transfer portion 14. In other words, the four toner images are simultaneously secondary-transferred onto the surface of the recording material P. To the secondary transfer roller 15, a predetermined voltage is applied during the secondary transfer of the toner image.

The sheet supply unit 16 includes upper and lower sheet supply cassettes 17 and 18 from which one sheet of the recording material P is selectively fed at a predetermined control timing depending on a recording material size or the like. The recording material P fed from the sheet supply unit 16 or the manual feed tray 19 is conveyed to registration rollers 210 through a sheet path 200. At that time, the registration rollers 210 are stopped, so that a leading end of the recording material P reaches the nip. Thereafter, rotational drive of the registration rollers 210 is started in synchronism with timings at which the image forming units start image forming operations, respectively. The timing of start of rotation of the registration roller 210 is set so that the leading end of the recording material P coincides with a leading end of the toner image transferred from the respective image forming units to the belt 8 at the secondary transfer portion 14.

The recording material P onto which the toner image is secondary-transferred from the surface of the belt 8 at the secondary transfer portion 14 is separated from the surface of the belt 8 and guided into a fixing apparatus (fixing unit) A by a conveyance guide 220. By the fixing apparatus A, the toner image is thermally fixed on the surface of the recording material P. The recording material P coming out of the fixing apparatus A is conveyed by inner and outer (sheet) discharge rollers 230 and 240 to be placed or stacked on a sheet discharge tray 250.

The toner remaining on the belt 8 without being not transferred onto the recording material P at the secondary transfer portion 14 is removed by a cleaning unit 90 for cleaning an image forming surface of the belt 8.

In a monochromatic image forming mode, only the first image forming unit UK for forming the black image is actuated for image formation, so that a recording material P on which a monochromatic toner image is formed is outputted.

The above described image forming apparatus functions as the copying machine by inputting a photoelectric reading image signal of an original image from the image reading portion 1 to the image output portion 2.

Further, the image forming apparatus functions as the printer by inputting an image signal from an external host apparatus such as a personal computer to the control unit 100. In addition, the image forming apparatus functions as the facsimile apparatus by inputting an image signal from another facsimile apparatus to the control unit 100 or sending the photoelectric reading image signal of the original image from the image reading portion 1 to another facsimile apparatus.

<Operation Step of Image Forming Apparatus>

Figure 2:
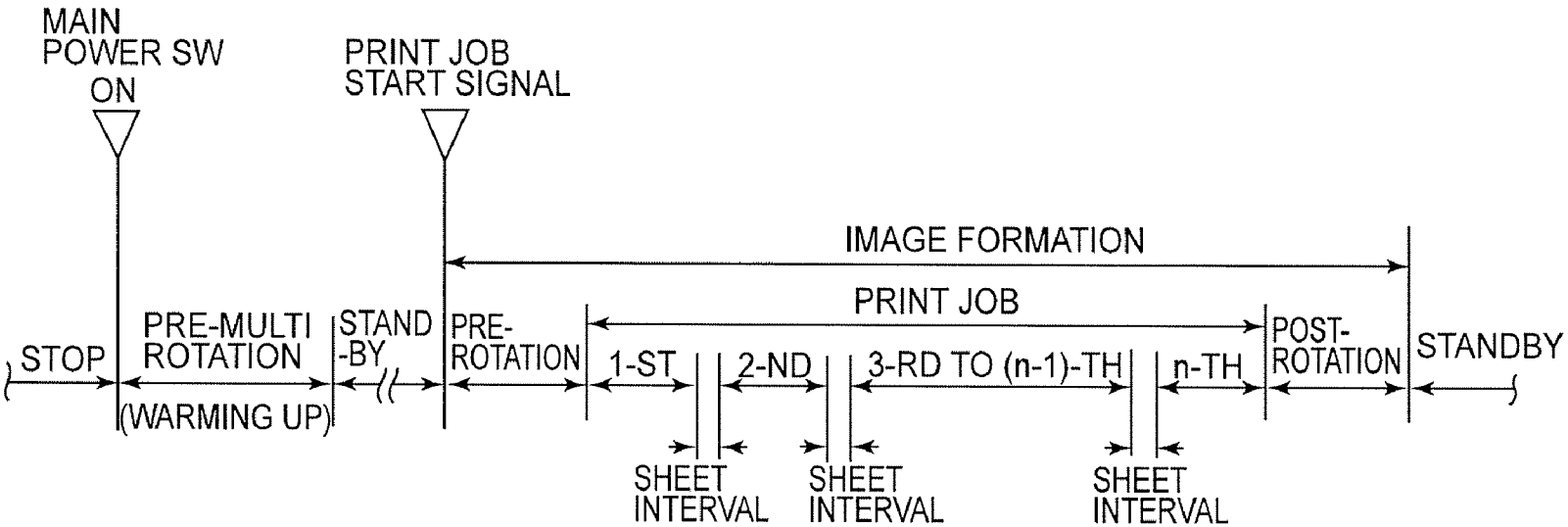
FIG. 2 is a schematic view for illustrating an operation of the image forming apparatus.

FIG. 2 is an operation process diagram of the image forming apparatus described above.

1) STOP: This is an OFF state of a main electric power switch of the image forming apparatus or an energy saving state in which the image forming apparatus requires warm(ing)-up for ensuring a standby state.
2) PRE-MULTI ROTATION: This is a startup operation step of the image forming apparatus in which a main motor is actuated by turning the main electric power switch on to perform a startup operation of required process equipment (hereinafter referred to as a "warm (ing)-up step").
3) STANDBY: This is period in which the image forming apparatus awaits an input of a print job start signal (image forming signal) by stopping the main motor after the warm-up step is completed.
4) IMAGE FORMATION: This is an image forming step including a pre-rotation step, a print job step, and a post-rotation step.

In the pre-rotation step, a print job pre-operation of the required process equipment is performed in a predetermined period by restarting the main motor on the basis of an input of a print signal as the image forming signal. A specific actual operation is performed by (a) receiving a print job start signal by the control unit 100, (b) decompressing an image by a formatter (a decompression time varies depending on an amount of image data or a processing speed of the formatter), and (c) starting the pre-rotation step in this order.

The print job step is a step in which the image forming process described above is performed after the pre-rotation step. In the case of a continuous print job, the above described image forming process is repeated, so that a set number of image-formed sheets are successively outputted. In this case, an interval between a trailing end of a recording material P and a leading end of a subsequent recording material P is a sheet interval in which the transfer portion and the fixing apparatus A are placed in a non-sheet-passing state.

The post-rotation step in which a print job post-operation of the required process equipment is performed by continuously driving the main motor even after the print job step for a predetermined number (one or a plurality) of sheets is completed.

5) STANDBY: This is a period in which the image forming apparatus awaits an input of a subsequent print job start signal by stopping the main motor after the post-rotation step is completed.

<Fixing Apparatus A>

The fixing apparatus A used in this embodiment is an image heating apparatus of a hot roller type and an electromagnetic induction heating type.

Figure 3:
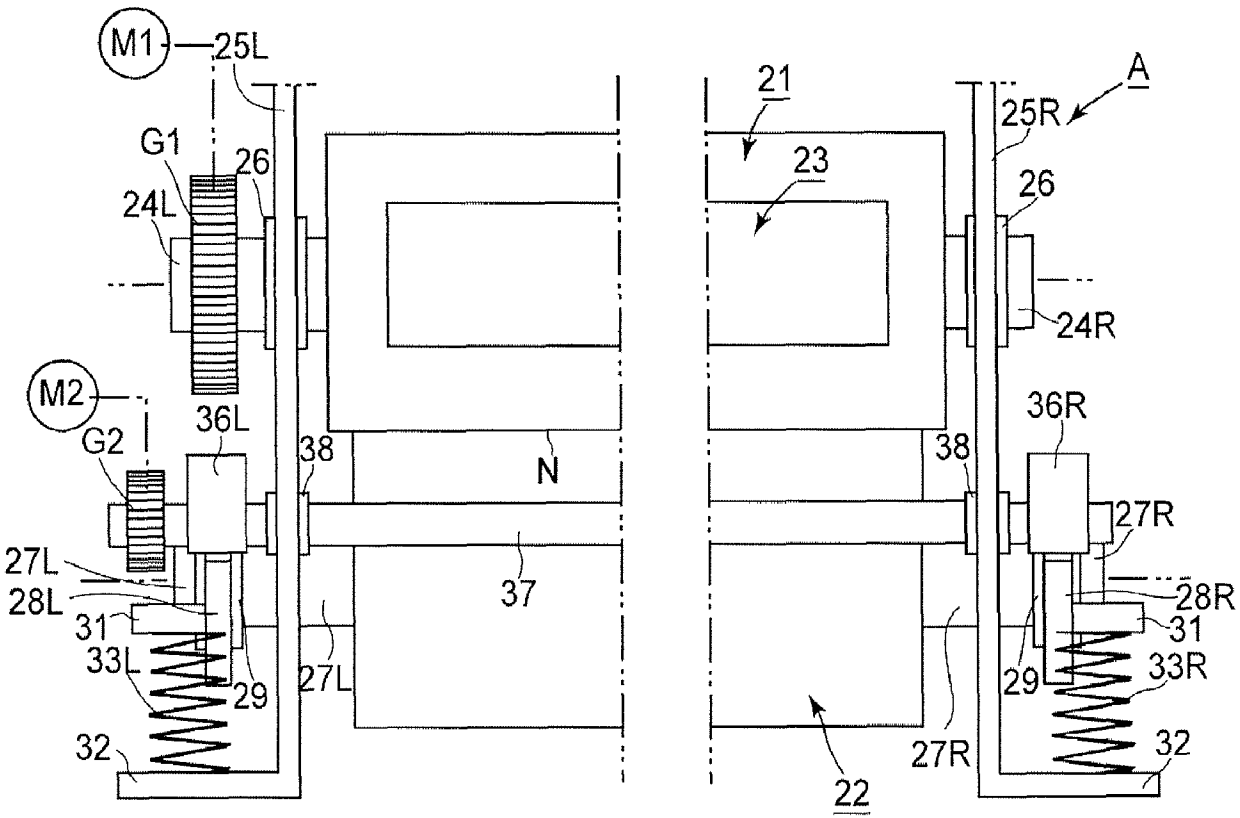
FIG. 3 is a schematic front view of a fixing apparatus a part of which is omitted.
Figure 4:
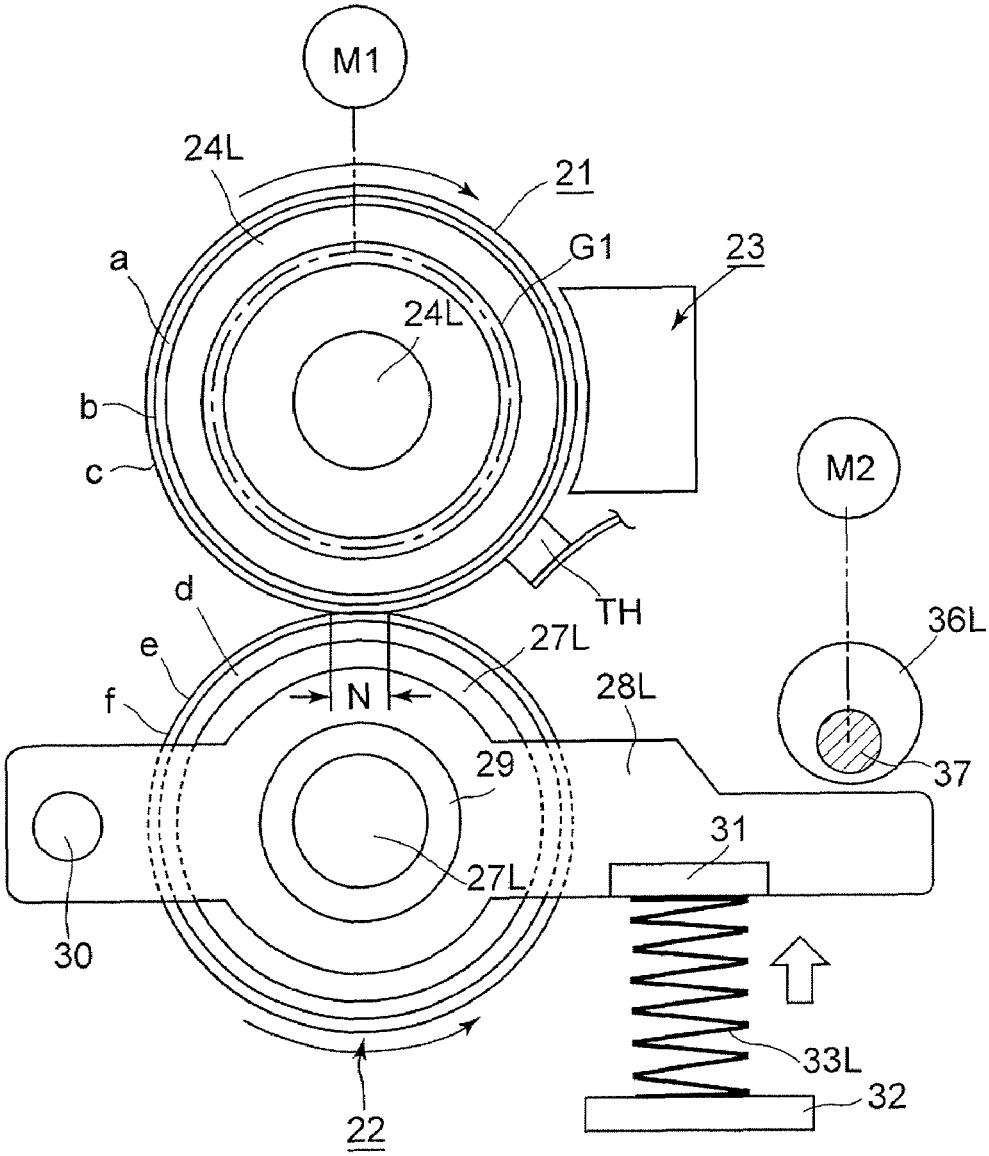
FIG. 4 is a schematic side view of a left-side pressing lever portion.
Figure 5:
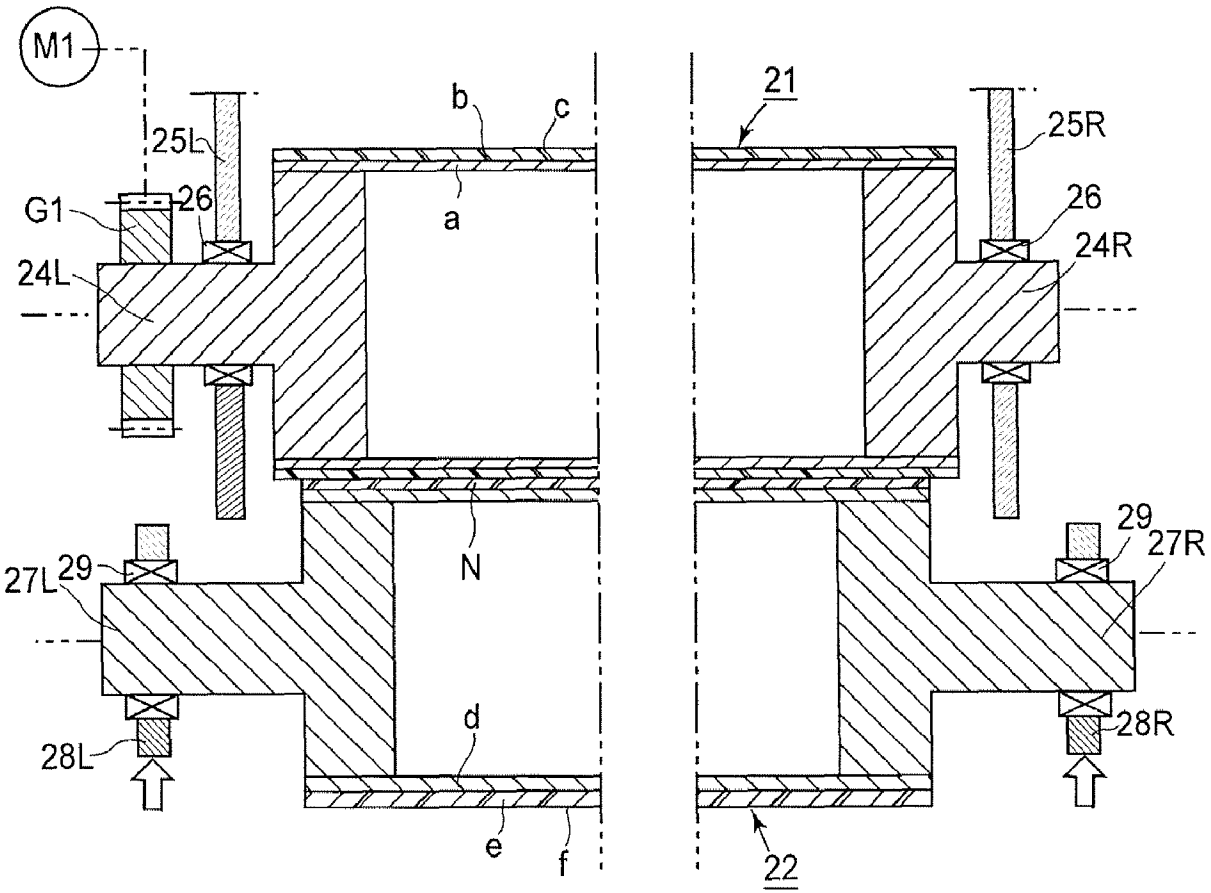
FIG. 5 is a schematic partial longitudinal sectional view of a fixing roller portion and a pressing roller portion.
Figure 6:
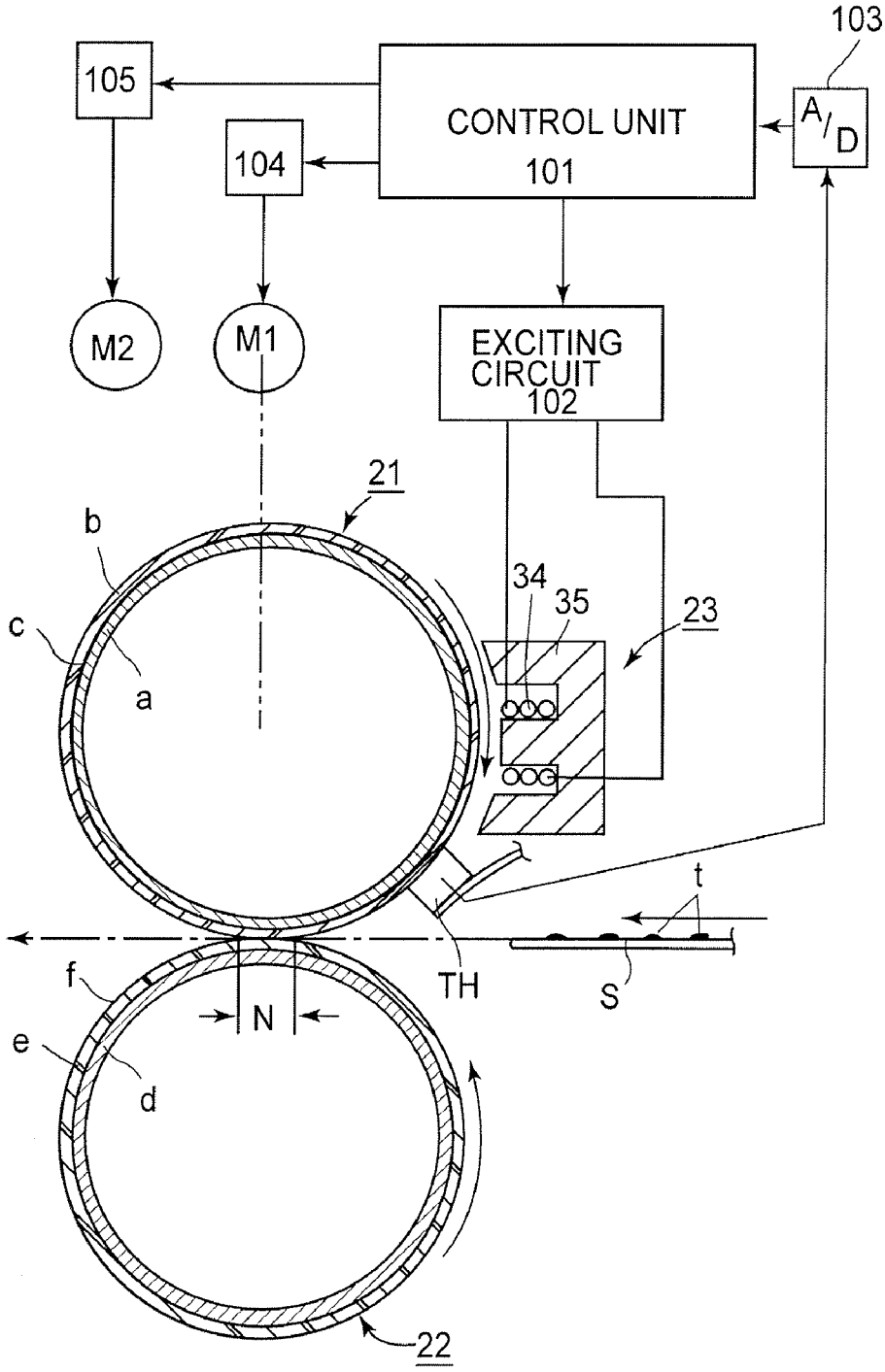
FIG. 6 is a schematic cross-sectional view of the fixing roller portion and the pressing roller portion and a block diagram of a control system.

FIG. 3 is a schematic front view of a fixing apparatus a part of which is omitted, FIG. 4 is a schematic side view of a left-side pressing lever portion, FIG. 5 is a schematic partial longitudinal sectional view of a fixing roller portion and a pressing roller portion, and FIG. 6 is a schematic cross-sectional view of the fixing roller portion and the pressing roller portion and a block diagram of a control system.

Here, with respect to the fixing apparatus, the front side is a recording material feeding side and a rear side is a recording material discharging side. Left and right sheets are both side surface sides when the fixing apparatus is viewed from the front side. An upstream side and a downstream side are taken with respect to a conveyance direction of the recording material. Further, a longitudinal direction is a direction of an axial line of rotation.

The fixing apparatus A includes a fixing roller 21 as the image heating member, a pressing roller 22 as the pressing member, and an induction heating coil unit (magnetic flux generation means) 23 having a coil as a heating means for locally heating the fixing roller 21.

The fixing roller 21 as the fixing member is a member capable of electromagnetic induction heating. In this embodiment, the fixing roller 21 includes an iron-made hollow core metal (induction heating member or electroconductive layer) a having an outer diameter of 50 mm and a thickness of 0.7 mm and a 1 mm-thick elastic layer b disposed at an outer peripheral surface of the core metal a. The elastic layer b may be formed of a known material such as a silicone rubber or a fluorine-containing rubber. Further, at an outer peripheral surface of the elastic layer b, the fixing roller 21 has a 30 μm-thick surface release layer c of a fluorine-containing resin (PFA or PTFE). As another material for the core metal a, e.g., it is possible to use a magnetic material (magnetic metal) such as an electroconductive magnetic stainless steel having a relatively high permeability μ and an appropriate resistivity ρ. Further, it is also possible to use a nonmagnetic material so long as it is formed in a thin film of an electroconductive material such as metal. At both (left and right) end portions of the fixing roller 21, shaft members (roller flanges) 24L and 24R are engaged, respectively, so as to be integral with the roller core metal a. The fixing roller 21 is rotatably supported between a left-side wall plate 25L and a right-side wall plate 25R so that the shaft portions of the left and right shaft members 24L and 24R are supported via bearing members 26. The shaft portion of the left shaft member 24L is outwardly from the bearing member 26 and at the protruded shaft portion, a fixing roller drive gear G1 is engaged integrally with the shaft portion.

The pressing roller 22 in this embodiment includes an iron-made hollow core metal d having an outer diameter of 50 mm and a thickness of 1.5 mm, a 1 mm-thick elastic layer e disposed at an outer peripheral surface of the core metal d, and a 30 μm-thick surface release layer f of a fluorine-containing resin (such as PFA or PTFE) at an outer peripheral surface of the elastic layer e. At both (left and right) end portions of the pressing roller 22, shaft members 27L and 27R are engaged, respectively, so as to be integral with the roller core metal d.

The pressing roller 22 is disposed below and in parallel with the fixing roller 21 and is pressed against the fixing roller 21 at a predetermined pressing force by a pressing mechanism as a contacting-and-separating means. More specifically, in this embodiment, the pressing roller 22 is rotatably supported between a left-side pressing lever 28L and a right-side pressing lever 28R so that the shaft portions of the left and right shaft members 27L and 27R are supported via bearing members 29. The pressing roller 22 is disposed below and in parallel with the fixing roller 21. The left and right pressing levers 28L and 28R are vertically swingable around a supporting shaft 30 on a rear end portion side with respect to the left-side and right-side wall plates 25L and 25R of the apparatus frame, respectively. These left and right pressing levers 28L and 28R are always urged upwardly by pressing springs 33L and 33R, respectively, compressively provided between a lever-side spring bearing seating 31 and an apparatus frame-side spring bearing seating 32 on a lever front portion side. In a free state of the left and right pressing levers 28L and 28R, an upper surface portion of the pressing roller 22 is pressed against a lower surface portion of the fixing roller 21 against elasticity of the elastic layers b and e of both rollers 21 and 22. By this pressing, a fixing nip (heating nip) N having a predetermined width in a sheet conveyance direction is formed between the fixing roller 21 and the pressing roller 22.

The induction heating coil unit 23 as the heating means for the fixing roller 21 includes an exciting coil 34 and a magnetic core 35. The exciting coil 34 and the magnetic core 35 are elongated members extending in a rotation axis direction of the fixing roller 21. The coil unit 23 is disposed outside the fixing roller 21 so that it is located closely opposite and parallel to a part of the fixing roller 21 and is fixedly supported by the apparatus frame via an unshown supporting means. The magnetic core 35 has E-shaped cross-section. Around a central projection of the E-shaped cross-section of the core 35, the exciting coil 34 is wound in a longitudinal direction. The exciting coil 34 comprises 20-150 litz wires each consisting of a conductive wire which has an outer diameter of 0.15-0.50 mm and is coated with an insulating material. The magnetic core 35 has the function of efficiently guiding AC magnetic flux generated by the exciting coil 34 to the hollow core metal a as the induction heating member constituting the fixing roller 21. The magnetic core 35 is formed of a material with a high permeability and a low loss.

The fixing roller 21 is rotationally driven in a clockwise direction of an arrow indicated in FIG. 4 at a predetermined speed by transmission of a driving force from a fixing drive motor Ml, as a drive means actuated by a motor control circuit 104 controlled by a control unit 101, to a gear G1 via a relay gear train. The pressing roller 22 is rotated by a frictional force with the fixing roller 21 in the fixing nip N.

The fixing roller 21 is locally heated through electromagnetic induction heating in a roller heating area as an opposing portion between the fixing roller 21 and the coil unit 23. More specifically, a high-frequency current is caused to pass through the exciting coil 34 of the coil unit 23 by an exciting circuit 102, thus generating an AC magnetic field. The resultant magnetic flux is absorbed in the roller heating area by the hollow core metal a as the induction heating member of the fixing roller 21 to generate eddy induction current in the core metal a. As a result, the core metal a is heated by Joul heat through a specific resistance. In this manner, the fixing roller 21 itself generates heat in the roller heating area through electromagnetic induction by the high-frequency current caused to pass through the exciting coil 34, thus being increased in temperature.

The fixing roller 21 is locally heated in the roller heating area as the opposing portion between the fixing roller 21 and the coil unit 23 but is uniformly heated at its entire circumference by rotation thereof. A surface temperature of the fixing roller 21 is detected by a temperature detection member TH such as a thermistor or the like. The temperature detection member TH is disposed in contact with the outer surface of the fixing roller 21 at a position in or close to the roller heating area. Electrical information about the fixing roller surface temperature detected by the temperature detection member TH is inputted into the control unit 101 via an A/D converter 103. The control unit 101 controls, on the basis of the inputted information, an amount of electric power supplied from the exciting circuit 102 to the exciting coil 33 of the coil unit 23 so that the surface temperature of the fixing roller 21 is kept at a setting temperature. In other words, temperature rise of the fixing apparatus A to a predetermined temperature and temperature control of the fixing apparatus A at the predetermined temperature are performed.

In the above described state of the fixing apparatus A, the recording material S having the surface on which the unfixed toner image t is formed is fed from the image forming portion to the fixing apparatus A and enters the fixing nip N with the unfixed toner image t carrying surface directed toward the fixing roller 21. In the fixing nip N, the recording material S is nipped and conveyed while hermetically contacting the outer peripheral surface of the fixing roller 21 at the unfixed toner image surface, thus being subjected to application of heat principally by the fixing roller 21 and pressure to fix the unfixed toner image t on its surface. The recording material S coming out of the fixing nip N is separated from the surface of the fixing roller 21 and conveyed to be discharged. By elastic deformation due to pressure application by the elastic layer b of the fixing roller 21 in the fixing nip N, it is possible to prevent winding of the recording material S about the fixing roller 21 and ensure a good separation performance.

The fixing roller 21 and the pressing roller 22 can be held in a separation state by a contacting-and-separating means (mechanism). In this embodiment, the fixing apparatus A is provided with left and right eccentric cams 36L and 36R for pressing the left and right pressing levers 28L and 28R supporting the pressing roller 22 down against the pressing springs 33L and 33R to move the pressing roller 22 apart from the fixing roller 21. These left and right eccentric cams 36L and 36R are fixedly provided in phase at both (left and right) end portions of a cam shaft 37 rotatably supported between the left and right side wall plates 25L and 25R of the apparatus frame via bearings 38. These eccentric cams 36L and 36R are located correspondingly above the front end portions of the left and right pressing levers 28L and 28R. At a left end portion of the cam shaft 37, a cam driving gear G2 is engaged integrally with the cam shaft 37.

The cam shaft 37 is rotated by transmission of a driving force from a cam drive motor M2 actuated by a motor control circuit 105 controlled by the control unit 101 to the gear G2 via a relay gear train. The control unit 101 controls the motor M2 via the motor control circuit 105 so that the cam shaft 37 is intermittently rotated a half turn. By this half-turn intermittent drive (rotation) of the cam shaft 37, the eccentric cams 36L and 37R are caused to switch between a first rotation angle state in which a major-diameter cam portion is directed upwardly and a second rotation angle state in which the major-diameter cam portion is directed downwardly.

When the eccentric cams 36L and 36R are switched to the first rotation angle state, the eccentric cams 36L and 36R are not in contact with the pressing levers 28L and 28R, respectively, as shown in FIG. 4. Accordingly, the pressing levers 28L and 28R are placed in the free state, so that the pressing roller 22 is kept in a pressing state (contact state) in which the pressing roller 22 contacts the fixing roller 21 at a predetermined pressing force by the pressing springs 33L and 33R.

Figure 7:
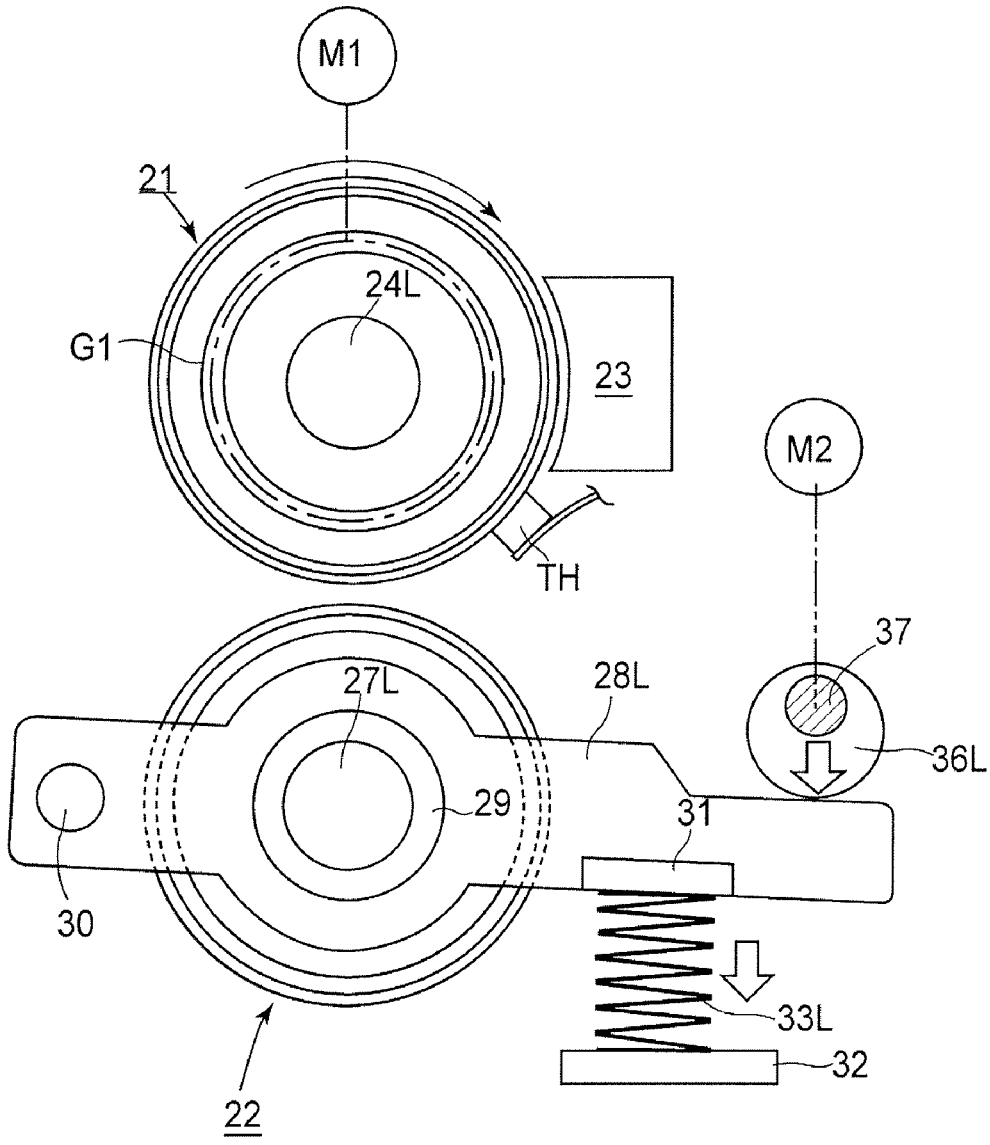
FIG. 7 is a schematic cross-sectional view showing a state in which the pressing roller is moved apart from the fixing roller and the fixing roller is rotated under heating.

When the eccentric cams 36L and 36R switched to the second rotation angle state, the eccentric cams 36L and 36R press the pressing levers 28L and 28R, respectively, down against the pressing springs 33L and 33R by the downwardly directed major-diameter cam portions as shown in FIG. 7. As a result, the pressing roller 22 is moved downwardly apart from the fixing roller 21 and kept in a separation state from the fixing roller 21.

<Control of Fixing Apparatus A>

1) During a stop state of an image forming apparatus in which a main electric power switch is turned off, drive and heating of the fixing apparatus are not effected.

The eccentric cams 36L and 36R as the contacting-and-separating means are held in the second rotation angle state, so that the pressing roller 22 is kept apart from the fixing roller 21. As a result, it is possible to prevent permanent set of the elastic layers b and e due to such a state that the fixing roller 21 and the pressing roller 22 always contact each other.

2) During the warm-up step performed when the main electric power switch is turned on, heating rotation of the fixing roller 21 is effected in the state in which the pressing roller 22 is kept apart from the fixing roller 21. More specifically, the control unit 101 keeps the eccentric cams 36L and 36R in the second rotation angle state, turning the fixing drive motor M1 on, and turning supply of electric power to the coil unit 23 on (FIG. 7) . As a result, heat transmission to the pressing roller 22 due to the contact between the pressing roller 22 and the fixing roller 21 is not caused to occur, so that it is possible to reduce a rise time required for increasing a temperature of the fixing roller 21 up to a predetermined temperature.

3) Also during standby of the image forming apparatus after completion of the warm-up step, the control unit 101 caused the fixing roller 21 to be heated and rotated by energization control so that a temperature of the fixing roller 21 is a predetermined target temperature of 200° C. in the state in which the pressing roller 22 is kept apart from the fixing roller 21. As a result, a temperature of the pressing roller 22 is not increased up to a temperature close to the fixing roller temperature, so that image failure such as uneven glossiness or the like is not caused to occur in a print job step of an image forming step after input of a print signal. In this embodiment, the fixing roller 21 is heated and rotated. However, in addition to the constitution of effecting continuous heating rotation during the standby, it is also possible to employ such a constitution that a heating rotation execution period and a heating rotation stop period are alternately repeated.

4) Next, an operation when an image forming signal is inputted during the execution of the heating rotation of the fixing member will be described.

In a pre-rotation step of the image forming step after the print signal is inputted, the control unit 101 turns the cam drive motor M2 on to switch the state of the eccentric cams 36L and 36R from the second rotation angle state to the first rotation angle state. As a result, the state of the pressing roller 22 is changed to a state in which the pressing roller 22 is caused to be pressed against (in contact with) the fixing roller 21.

The control unit 101 turns the electric power supply to the coil unit 23 off and stops the heating of the fixing roller 21 before the pressing roller 22 is switched from the separation state to the pressing state. Further, when the signal for switching the pressing roller 22 from the separation sensor to the pressing state is inputted, the control unit 101 turns the fixing drive motor M1 off and stops the rotation of the fixing roller 21. With respect to an operational relationship between the turning-off of the energization and the rotation stop, it is preferable that the rotation is stopped after the timing of the energization turning-off. In the state of the rotation stop and heating stop of the fixing roller 21, the control unit 101 changes the state of the pressing roller 22 to the pressing state in which the pressing roller 22 is pressed against the fixing roller 21 by turning the cam drive motor M2 on to switch the eccentric cams 36L and 36R from the second rotation angle state to the first rotation angle state. When the pressing roller 22 contacts the fixing roller 21 to be switched to the pressing state, the control unit 101 turns the fixing drive motor M2 on and thereafter turns the electric power supply to the coil unit 23 on to resume the heating rotation of the fixing roller 21. The pressing roller 22 is rotated by the rotation drive of the fixing roller 21. The electric power is supplied after the fixing drive motor M1 is turned on, so that a local temperature rise of the fixing roller 21 can be desirably prevented.

In this embodiment, the control unit 101 recognizes that the pressing roller 22 contacts the fixing roller 21 to be placed in the pressing state (completion of the pressing) by completion and termination of the half-turn drive of the eccentric cams 36L and 36R.

Thereafter, in the print job step, in the fixing nip N between the fixing roller 21 and the pressing roller 22, the recording material S having thereon the unfixed toner image t is conveyed. At this time, the temperature of the fixing roller 21 is controlled to be the target temperature of 200° C.

Figure 8:
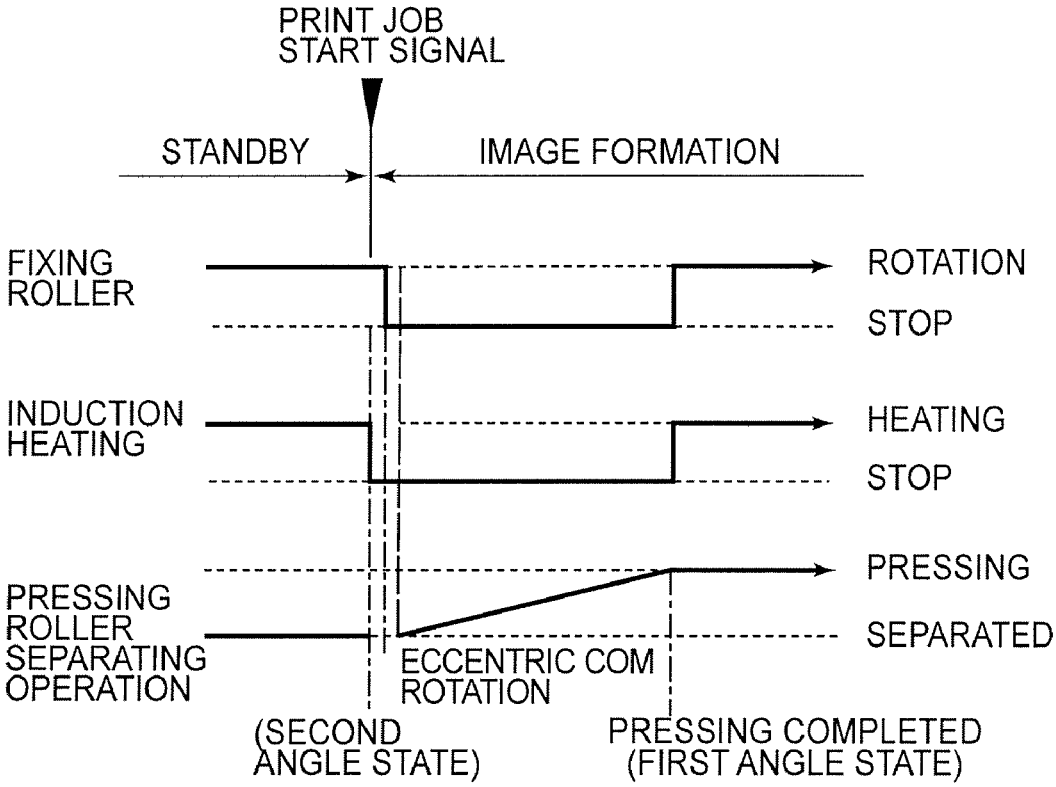
FIG. 8 is a timing chart of a pressing operation.
Figure 9:
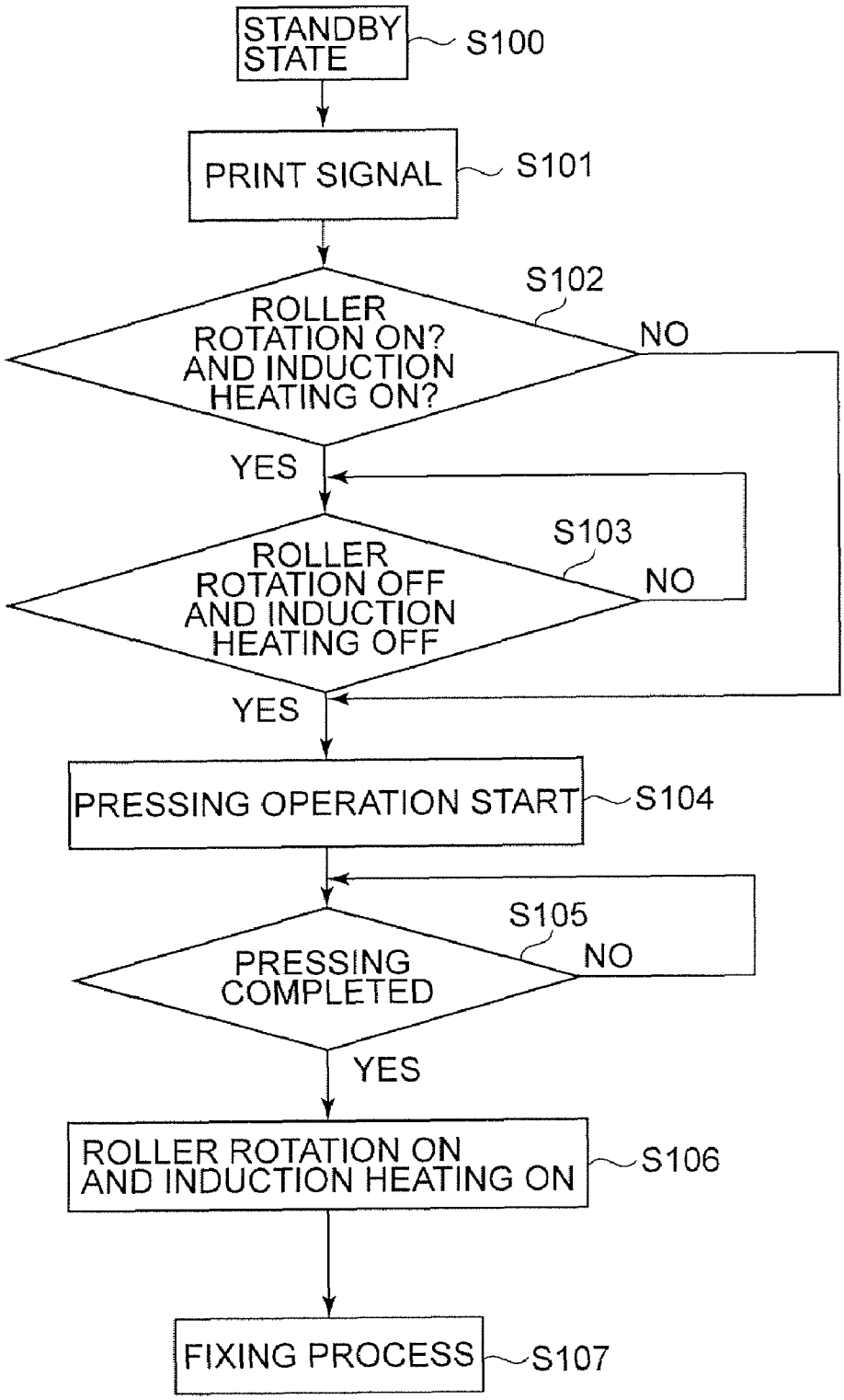
FIG. 9 is a flow chart from a standby state to a fixing process.

FIG. 8 is a timing chart of rotation and induction heating of the fixing roller 21 when the pressing roller 22 is shifted from the separation state to the pressing state. FIG. 9 is a flow chart of an operation of the fixing apparatus from standby to a fixing process of the image forming step as described above.

Referring to FIG. 8, when the image forming signal is inputted during the rotation of the fixing roller, induction heating is turned off on the basis of the signal. The rotation of the fixing roller is stopped simultaneously with or after the timing of the turning-off of the induction heating. At the same time as or after the rotation stop, rotation of the eccentric cams is started. Then, after the rotation of the eccentric cams is stopped, the rotation and induction heating of the fixing roller are started.

Referring to FIG. 9, during a rotation period of the fixing roller in a standby state of the image forming apparatus (S100), a print signal as an image forming signal is inputted (S101) When a roller rotation and induction heating (S102) are effected during the input of the print signal, control for stopping the roller rotation and the induction heating (S103) is effected. In the cases where the roller rotation and the induction heating are not effected and where the stop of the rotation and the heating is completed, the operation goes to a pressing operation (S104). After completion of the pressing operation (S105), the roller rotation and the induction heating are started again (S106) and a fixing process is performed (S107).

As described above, by stopping the rotation of the fixing roller 21 when the separation state between the fixing roller 21 and the pressing roller 22 is shifted to the pressing state therebetween, occurrences of abrasion and scars of the roller surface layer due to a difference in peripheral speed between the rollers 21 and 22 are prevented.

Further, simultaneously with the rotation stop of the fixing roller 21, the electric power supply to the coil unit 23 as the local heating means for the fixing roller 21 is turned off. As a result, it is also possible to prevent a deterioration of the surface layer or the like and the uneven glossiness of an image to be outputted.

5) After the image forming step is completed, the control unit 101 turns the cam drive motor M2 on to switch the eccentric cams 36L and 36R from the first rotation angle state to the second rotation angle state to change the state of the pressing roller 22 to the separation state from the fixing roller 21. Further, the control unit 101 keeps on-state of the fixing drive motor M1 and the electric power supply to the coil unit 23 to perform the heating rotation of the fixing roller 21, thus awaiting input of a subsequent print signal.

Incidentally, a control temperature of the fixing roller 21 subjected to the heating rotation during the standby may be a fixing process temperature in the print job step or a standby temperature set to be lower than the fixing process temperature by a predetermined value.

In this embodiment, as described above, other than the constitution in which the heating rotation of the fixing roller 21 is continued during the standby, it is also possible to employ the constitution in which the heating rotation execution period and the heating rotation stop period are alternately repeated. This constitution will be described more specifically. When the temperature of the fixing member is lower than a preliminarily set first temperature, the operation period goes to the heating rotation execution period. Then, the period further goes to the heating rotation stop period depending on such a temperature condition that the fixing member temperature reaches the first temperature or a temperature higher than the first temperature or a time condition such that a preliminarily set time has elapsed. In this case, when the image forming signal is inputted during the heating rotation period, the heating rotation is interrupted and the above described operation is performed. The operation after the input of the image forming signal is identical to that described above.

As described above, in this embodiment, the temperature of the pressing roller 22 is not excessively increased by moving the pressing roller 22 apart from the fixing roller 21, whereby a reduction in warm-up time and prevention of an occurrence of image failure such as uneven glossiness or the like are realized. Further, it is possible to prolong the life of the fixing apparatus by preventing damage on the fixing roller 21 occurring during the pressing operation between the fixing roller 21 and the pressing roller 22.

Embodiment 2

In Embodiment 1, the electric power supply (energization) to the coil is turned off when the pressing operation is effected. In this embodiment, the pressing operation is effected while performing the energization of the coil. In other points, the constitution is the same as that of Embodiment 1.

In this embodiment, in the standby state, energization control is performed during the heating rotation so that the temperature of the fixing belt is the target temperature of 200° C. When the fixing belt is stopped at the temperature, only a temperature of a part of the fixing belt is an extremely high temperature, so that uneven glossiness of an output image is caused to occur. Therefore, in this embodiment, the target temperature during the pressing operation is switched so as not to cause the uneven glossiness of the output image even when the pressing operation is performed while effecting heating of the part of the fixing belt through the energization during the stop of the fixing belt.

More specifically, in this embodiment, the target temperature is switched to 50° C. so as to be lower than that in the standby state. Further, a maximum amount of electric power supplied to the coil is decreased from 800 W in the standby state to 200 W during the pressing operation, whereby it is possible to alleviate the uneven glossiness of subsequent output images.

According to this embodiment, it is possible to alleviate the uneven glossiness of output image even when the fixing belt is heated in a state in which the fixing member is stopped during the pressing operation.

Embodiment 3

Figure 10:
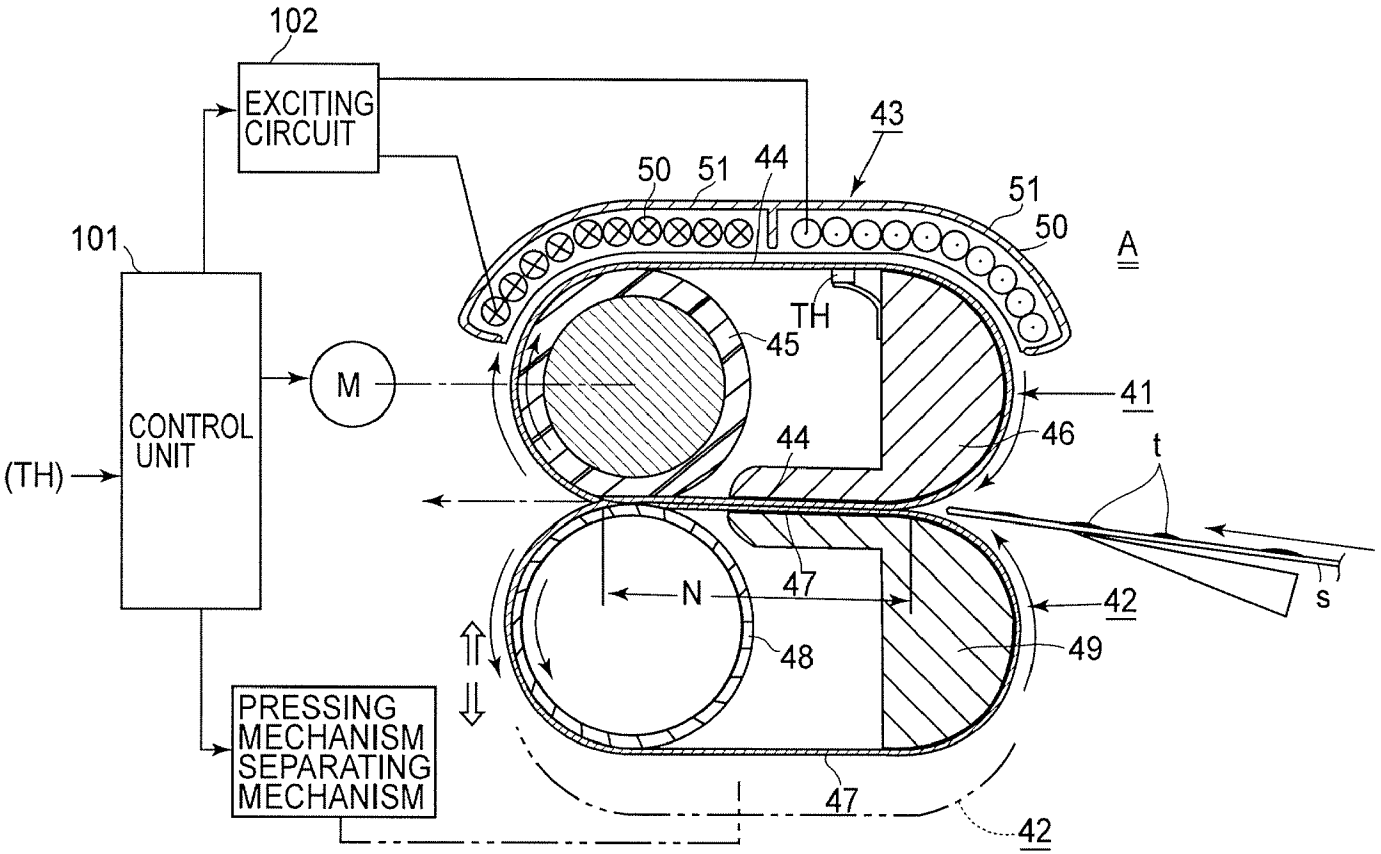
FIG. 10 is a schematic sectional view of a principal portion of a fixing apparatus in Embodiment 3.

FIG. 10 is a cross-sectional side view showing a schematic constitution of a fixing apparatus A in this embodiment. This fixing apparatus A is of a twin belt-type wherein both the fixing member and the pressing member are constituted by a belt and is an image heating apparatus of an electromagnetic induction heating type in which the fixing belt is heated through induction heating.

Referring to FIG. 10, the fixing apparatus A includes a fixing belt unit 41 and a pressing belt unit 42 which are vertically disposed and caused to contact each other by an unshown pressing mechanism to form a fixing nip N between the units 41 and 42. The fixing apparatus A further includes an induction heating unit (magnetic flux generation means) 43 as a heating means and is disposed above the fixing belt unit 41.

The fixing belt unit 41 includes a first roller 45 and a first guide member 46 which are disposed substantially in parallel to each other with respect to a frame (not shown) of the fixing belt unit 41 and an endless and flexible fixing belt (fixing member) 44, as an image heating member to be induction-heated, stretched extended around both the members 45 and 46.

The pressing belt unit 42 includes a second roller 48 and a second guide member 49 which are disposed substantially in parallel to each other with respect to a frame (not shown) of the pressing belt unit 42 and an endless and flexible pressing belt (pressing member) 47 stretched and extended around both the members 48 and 49.

In a pressing state between the fixing belt unit 41 and the pressing belt unit 42, the first roller 45 and the second (pressing) roller 48 are oppositely in contact with each other via the fixing belt 44 and the pressing belt 47. Further, the first guide member 46 and the second guide member 49 are oppositely in contact with each other via the fixing belt 44 and the pressing belt 47. As a result, a lower belt portion of the fixing belt 44 and an upper belt portion of the pressing belt 47 contact each other to form the fixing nip N having a large width in a sheet conveyance direction.

The first roller 45 is rotationally driven at a predetermined control speed in a clockwise direction of an indicated arrow by a fixing drive motor M, whereby the fixing belt 44 is rotationally driven. The pressing belt 47 is rotated by a frictional force thereof with the fixing belt 44 in the fixing nip N. By the rotation of the pressing belt 47, the second roller 48 is also rotated.

The coil unit 43 is the heating means for heating the fixing belt 44 and is disposed above and close to the upper surface of the fixing belt 44 with a predetermined gap therebetween. The coil unit 43 includes an exciting coil 50 and a magnetic core 51.

The fixing belt 44 is locally heated through electromagnetic induction heating in a belt heating area as an opposing portion between the fixing belt unit 44 and the coil unit 43. More specifically, a high-frequency current is caused to pass through the exciting coil 50 of the coil unit 43 by an exciting circuit 102, thus generating an AC magnetic field. The resultant magnetic flux is absorbed in the belt heating area by metal belt (electroconductive layer) as a base layer of the fixing belt 44 to generate eddy induction current in the metal belt. As a result, the metal belt generates heat by its specific resistance. Thus, in the belt heating area, the fixing belt 44 itself generates heat by the high-frequency current caused to pass through the coil 50 and is increased in temperature by heating. Further, by the rotation of the fixing belt 44, an entire peripheral surface of the fixing belt 44 is heated and increased in temperature.

The temperature control of the fixing belt 44 is performed in the same manner as in that of the fixing roller in the fixing apparatus of Embodiment 1. Into the fixing apparatus A, a recording material S having a surface on which an unfixed toner image t is formed is fed from the image forming portion side and then enters the fixing nip N in which the recording material S is nipped and conveyed to fix thereon the unfixed toner image t.

Also in the fixing apparatus in this embodiment, control similar to that in the fixing apparatus of Embodiment 1 is effected by a control unit 101 in the following manner.

1) During a stop state of an image forming apparatus in which a main electric power switch is turned off, drive and heating of the fixing apparatus are not effected.

The pressing belt unit 42 is held at a lower position (indicated by a chain double-dashed line) in noncontact with the fixing belt unit 41 by a separation mechanism, so that the pressing belt 47 is kept apart from the fixing belt 44.

2) During the warm-up step performed when the main electric power switch is turned on, the control unit 101 turns the fixing driven motor M on while holding the pressing belt unit 42 at the lower position in noncontact with the fixing belt unit 41 by the separation mechanism. Further, the control unit 101 turns supply of electric power to the coil unit 43 on. As a result, heating rotation of the fixing belt 44 is effected. In this case, heat transmission to the pressing belt 47 due to the contact between the pressing belt 47 and the fixing belt 44 is not caused to occur, so that it is possible to reduce a rise time required for increasing a temperature of the fixing belt 44 up to a predetermined temperature.

3) Also during standby of the image forming apparatus after completion of the warm-up step, the control unit 101 caused the fixing belt 44 to be heated and rotated at the predetermined temperature while holding the pressing belt unit 42 at the lower position in noncontact with the fixing belt unit 41 by the separation mechanism. As a result, a temperature of the pressing belt 47 is not increased up to a temperature close to the fixing belt temperature, so that image failure such as uneven glossiness or the like is not caused to occur in a print job step of an image forming step after input of a print signal. In this embodiment, the fixing belt 44 is heated and rotated. However, in addition to the constitution of effecting continuous heating rotation during the standby, it is also possible to employ such a constitution that a heating rotation execution period and a heating rotation stop period are alternately repeated.

4) In a pre-rotation step of the image forming step after the print signal is inputted, the control unit 101 release the holding of the fixing belt unit 43 at the lower position by the separation mechanism. As a result, the state of the pressing belt unit 42 is changed to a state in which the pressing belt unit 42 is caused to be pressed against (in contact with) the fixing belt unit 41. In other words, the pressing belt 47 is placed in a pressing state in which the pressing belt 47 is pressed against the fixing belt 44.

The control unit 101 turns the electric power supply to the coil unit 43 off and stops the heating of the fixing belt 44 when the pressing belt 47 is switched from the separation state to the pressing state. Further, when the pressing belt 47 is switched from the separation sensor to the pressing state, the control unit 101 turns the fixing drive motor M off and stops the rotation of the fixing belt 44. With respect to an operational relationship between the turning-off of the energization and the rotation stop, it is preferable that the rotation is stopped at or after the timing of the energization turning-off. In the state of the rotation stop and heating stop of the fixing belt 44, the control unit 101 release the separation mechanism and changes the state of the pressing belt 47 to the pressing state in which the pressing belt 47 is pressed against the fixing belt 44 by the pressing mechanism. When the pressing belt 47 contacts the fixing belt 44 to be switched to the pressing state, the control unit 101 turns the fixing drive motor M on and thereafter turns the electric power supply to the coil unit 43 on to resume the heating rotation of the fixing belt 44.

Thereafter, in the print job step, in the fixing nip N between the fixing belt 44 and the pressing belt 47, the recording material S having thereon the unfixed toner image t is conveyed.

As described above, by stopping the rotation of the fixing belt 44 when the separation state between the fixing belt 44 and the pressing belt 47 is shifted to the pressing state therebetween, occurrences of abrasion and scars of the roller surface layer due to a difference in peripheral speed between the belts 44 and 47 are prevented.

Further, simultaneously with the rotation stop of the fixing belt 44, the electric power supply to the coil unit 43 as the local heating means for the fixing belt 44 is turned off. As a result, it is also possible to prevent a deterioration of the rubber material and the surface layer or the like due to excessive temperature rise at a part of the fixing belt 44 and the uneven glossiness of an image to be outputted.

5) After the image forming step is completed, the control unit 101 changes the state of the pressing belt 47 to the separation state from the fixing belt 44 by the separation mechanism. Further, the control unit 101 keeps on-state of the fixing drive motor M and the electric power supply to the coil unit 43 to continue the heating rotation of the fixing belt 44, thus awaiting input of a subsequent print signal.

A control temperature of the fixing belt 44 subjected to the heating rotation during the standby may be a fixing process temperature in the print job step or a standby temperature set to be lower than the fixing process temperature by a predetermined value.

Incidentally, in this embodiment, although specific constitutions of the pressing mechanism and separation mechanism for the pressing belt unit 42 with respect to the fixing belt unit 44 are omitted, it is possible to employ the pressing mechanism by a combination of the pressing levers and the pressing springs and the separation mechanism by the eccentric cams as in Embodiment 1. Further, it is also possible to employ other appropriate mechanisms.

The constitutions of the fixing apparatus are not limited to those in Embodiments 1 to 3 described above and may, e.g., be modified into the following constitutions.

1) In the fixing apparatus of Embodiment 1, the pressing roller 22 as the pressing member may be changed to a pressing belt. Further, in the fixing apparatus in Embodiment 3, the pressing belt 47 as the pressing member may be changed to a pressing roller.
2) The pressing roller 22 or the pressing belt 47 as the pressing member may be provided with a heating means and a driving source, so that in the state in which the pressing member is kept apart from the fixing member, the pressing member may be independently rotationally driven and independently temperature-controlled at a temperature lower than the temperature of the fixing member.

In this case, during the pressing operation for shifting the separation state to the contact state between the fixing member and the pressing member, these members are placed in the contact state by stopping the rotation and heating of both the members. Thereafter, the rotation and heating of both the members are effected.

3) As the heating means for locally heating the fixing member or the pressing member, other than the induction heating coil unit, it is also possible to use an infrared ray lamp, a high-frequency irradiation unit, and a ceramic heater unit or the like configured to contact the fixing member or the pressing member or controlled to move toward and apart from the fixing member or the pressing member.
4) The contact and separation between the fixing member and the pressing member may also be performed by a constitution in which the fixing member is moved toward and apart from the pressing member or a constitution in which both of the fixing member and the pressing member are moved toward and apart from each other.

As described hereinabove, according to the present invention, it is possible to prevent the irregularity in temperature of the fixing member caused during the shift from the separation state to the pressing state between the fixing member and the pressing member on the basis of the image forming signal.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 098916/2006 filed Mar. 31, 2006, which is hereby incorporated by reference.

What is claimed is:

1. An image heating apparatus comprising:

a rotatable image heating member for heating an image on a recording material;

a pressing member for forming a nip with said image heating member in which the recording material is nipped and conveyed;

heating means for heating a part of said image heating member;

drive means for rotating said image heating member;

contacting and separating means for contacting and separating said image heating member and said pressing member relative to each other;

an executing portion for executing a heating operation for heating said image heating member while rotating said image heating member separated from said pressing member during a stand-by state awaiting input of an image forming signal;

a stop control portion for stopping energization to said heating means and rotation of said image heating member when an image forming signal is input during the execution of the heating operation by said executing portion;

a contact operation control portion for carrying out a contact operation between said image heating member and said pressing member by said contacting and separating means during a period in which energization to said heating means and rotation of said image heating member are stopped; and a start control portion for resuming energization to said heating means and rotation of said image heating member after contact of said image heating member and said pressing member is complete.

2. An image heating apparatus according to claim 1, wherein said image heating member is an endless belt.

3. An image heating apparatus according to claim 1, wherein said heating means is magnetic flux generation means, and wherein said image heating member has an electroconductive layer for generating heat by eddy current caused by magnetic flux generated by said magnetic flux generation means.

4. An image heating apparatus according to claim 1, further comprising temperature detecting means for detecting a temperature of said image heating member and an energization control portion for controlling energization to said heating means on the basis of an output of said temperature detecting means.

5. An image heating apparatus according to claim 1, wherein said pressing member is a belt member.

6. An image heating apparatus comprising:

a rotatable image heating member for heating an image on a recording material;

a pressing member for forming a nip with said image heating member in which the recording material is nipped and conveyed;

heating means for heating a part of said image heating member;

a temperature detection member for detecting a temperature of said image heating member;

power control means for controlling electric power to be supplied to said heating means on the basis of an output of said temperature detection member;

drive means for rotating said image heating member;

contacting and separating means for contacting and separating said image heating member and said pressing member relative to each other;

an executing portion for executing a heating operation for heating said image heating member while rotating said image heating member separated from said pressing member during a stand-by state awaiting input of an image forming signal;

setting means for performing a setting operation for setting an electric power value so that the temperature of said image heating member is lower than that of said image heating member during the heating operation;

a contact operation control portion for carrying out a contact operation between said image heating member and said pressing member by said contacting and separating means during a period in which the setting operation for setting the electric power value is performed by said setting means and rotation of said image heating member is stopped; and a start control portion for performing an operation of applying electric power having a value larger than that set by said setting means to said heating means and resuming rotation of said image heating member after contact of said image heating member and said pressing member is complete.

7. An image heating apparatus according to claim 6, wherein when the setting operation for setting the electric power value is performed by said setting means, a maximum value of electric power capable of being supplied to said heating means by said power control means is lower than that of electric power capable of being supplied to said heating means by said power control means during the heating operation.

8. An image heating apparatus according to claim 6, wherein said power control means controls supply of electric power to said heating means during the heating operation so that the temperature of said heating means is a first target temperature which has been set, and controls supply of electric power to said heating means during the setting operation so that the temperature of said heating means is a second target temperature lower than the first target temperature.

9. An image heating apparatus according to claim 6, wherein rotation of said image heating member is stopped after the setting operation for setting the electric power value is performed by said setting means.

10. An image heating apparatus according to claim 6, wherein said image heating member is an endless belt.

11. An image heating apparatus according to claim 6, wherein said heating means is magnetic flux generation means, and wherein said image heating member has an electroconductive layer for generating heat by eddy current caused by magnetic flux generated by said magnetic flux generation means.

12. An image heating apparatus according to claim 6, wherein said pressing member is a belt member.

* * * * *